United States Patent [19]

Ulrich et al.

[11] Patent Number: 4,469,327

[45] Date of Patent: Sep. 4, 1984

[54] AMUSEMENT GAME DEVICE

[75] Inventors: Hans Ulrich, Wuppertal, Fed. Rep. of Germany; Fred D. Eddins, Mapleville, R.I.; Tormod K. Reinertsen, Rehoboth, Mass.; Steven R. D'Aguanno, Greenville; Americo D'Ambra, Jr., Johnston, both of R.I.

[73] Assignee: Hasbro Industries, Inc., Pawtucket, R.I.

[21] Appl. No.: 358,511

[22] Filed: Mar. 15, 1982

[51] Int. Cl.[3] ..... A63F 9/00

[52] U.S. Cl. ..... 273/1 GG; 446/330; 414/7

[58] Field of Search ..... 273/1 G, 1 GD, 1 GF, 273/1 GG, 1 GE; 46/123, 124, 152; 414/1, 7, 909, 915; 52/121, 117, 2; 16/DIG. 13

[56] References Cited

U.S. PATENT DOCUMENTS

| | | | |
|---|---|---|---|
| 243,512 | 6/1881 | Clement | 46/123 X |
| 272,189 | 2/1883 | Barnard | 46/123 X |
| 1,928,418 | 9/1933 | Garland | 46/123 X |
| 2,526,612 | 10/1950 | Rudolf | 46/123 X |
| 2,845,748 | 8/1958 | Derham | 46/152 |
| 2,853,831 | 9/1958 | Bischoff | 46/123 |
| 3,445,052 | 5/1969 | Lewallen | 16/DIG. 13 X |
| 3,578,319 | 5/1971 | Kohner et al. | 273/1 GG |
| 3,744,601 | 7/1973 | Doppelt | 16/DIG. 13 X |
| 3,793,612 | 2/1974 | Driscoll | 16/DIG. 13 X |
| 3,866,966 | 2/1975 | Skinner | 414/1 X |
| 4,119,312 | 10/1978 | Todokoro | 273/1 GE |

FOREIGN PATENT DOCUMENTS

| | | | |
|---|---|---|---|
| 2517078 | 10/1976 | Fed. Rep. of Germany | 16/DIG. 13 |
| 686700 | 3/1965 | Italy | 16/DIG. 13 |
| 139849 | 3/1953 | Sweden | 46/123 |
| 901135 | 7/1962 | United Kingdom | 46/124 |
| 1232580 | 5/1971 | United Kingdom | 16/DIG. 13 |

*Primary Examiner*—Paul E. Shapiro

*Attorney, Agent, or Firm*—Salter & Michaelson

[57] ABSTRACT

An amusement game device generally in the configuration of a dragon-like figure including a body portion having an open cup portion therein, an elongated flexible neck member which normally extends outwardly from the body portion, and a head portion which is attached to the neck member and includes an outwardly extending hook-like tongue. A tail on the device which extends rearwardly from the body portion is manipulatable to curl the neck member upwardly and rearwardly to move the head portion to the interior of the cup portion or slightly thereabove whereby ring-like game elements disposed on the hook-like tongue may be deposited in the cup portion by manipulting the tail.

7 Claims, 5 Drawing Figures

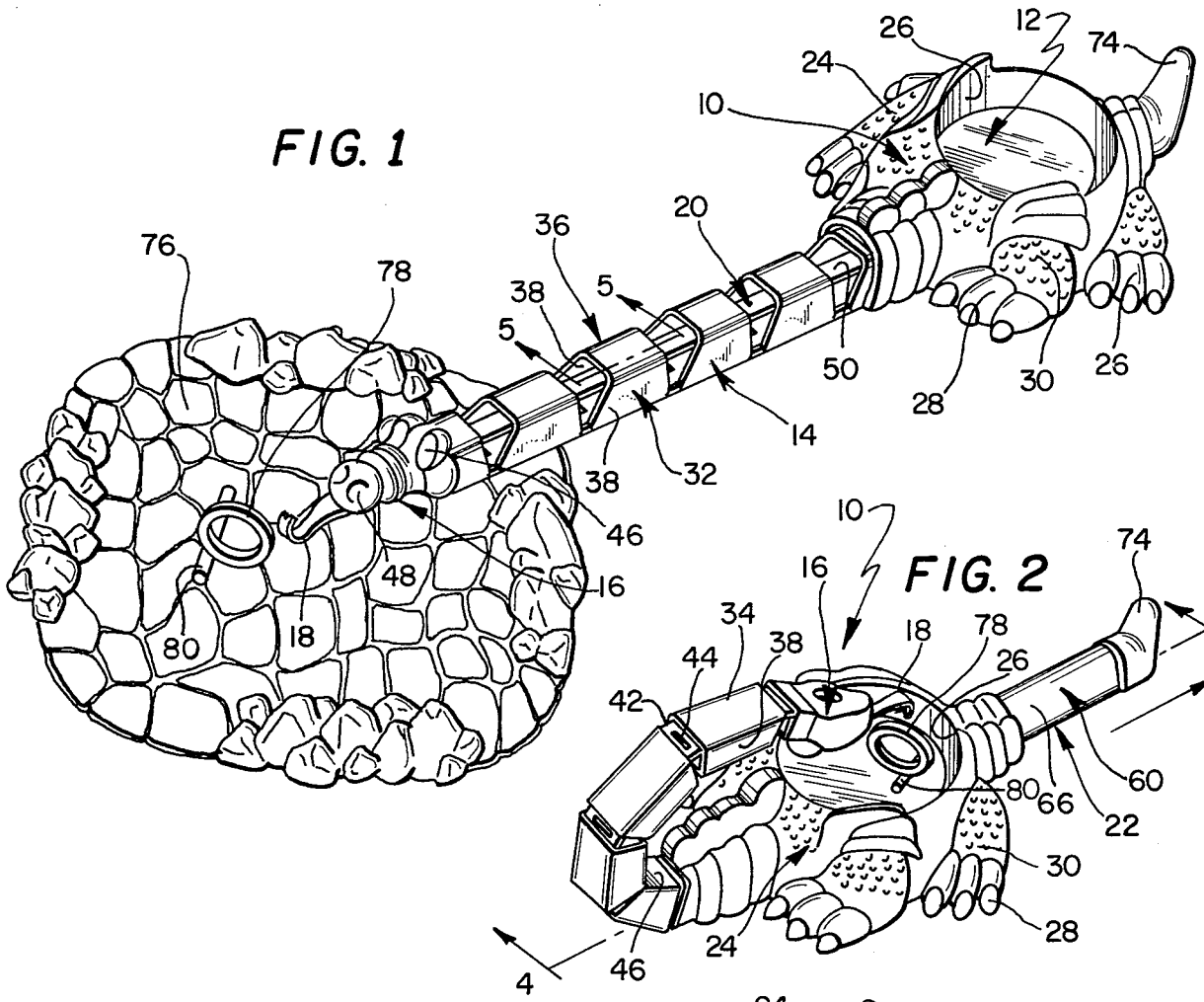
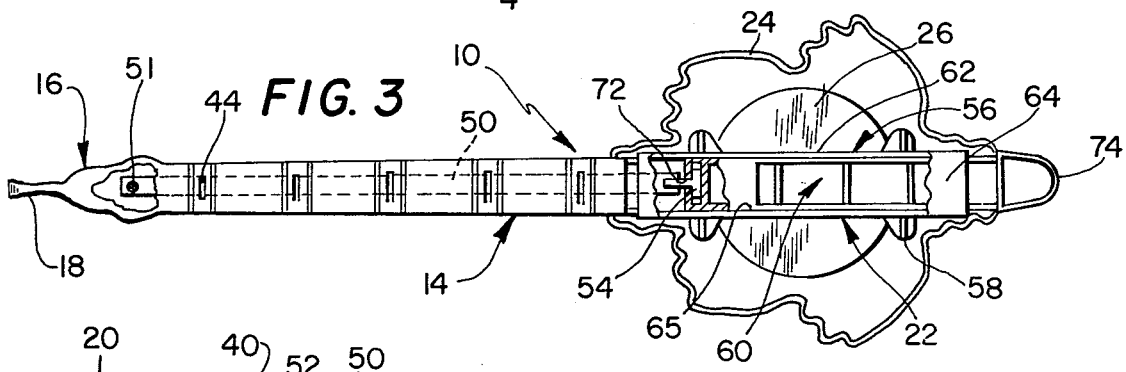
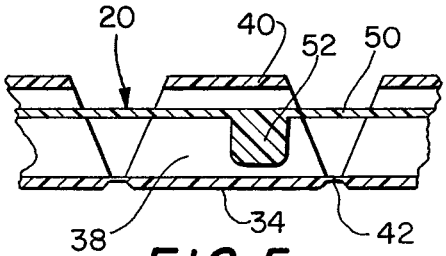
FIG. 5
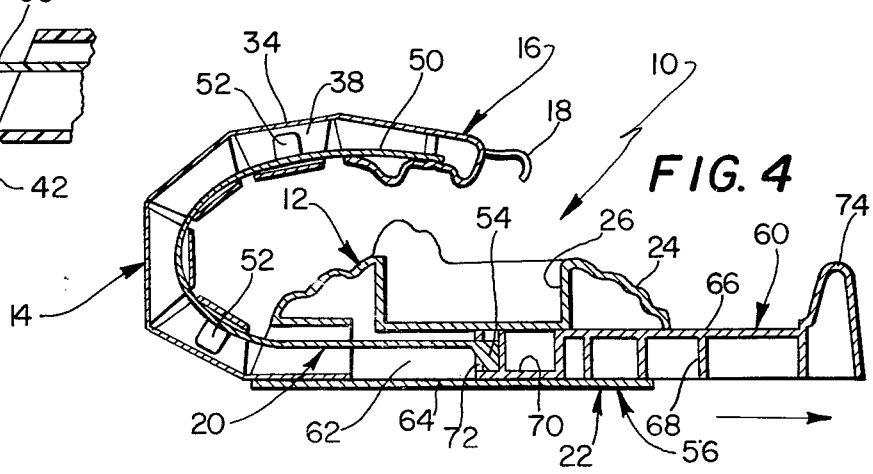

AMUSEMENT GAME DEVICE

BACKGROUND AND SUMMARY OF THE INVENTION

The instant invention relates to amusement games and the like and more particularly to a novel amusement game device.

The device of the instant invention is, in the preferred embodiment, generally in the configuration of a dragon-like figure having a body portion, an elongated flexible neck portion, and a head portion which includes an outwardly extending hook-like tongue. An open cup portion is mounted within the body portion and a dragon-like tail extends rearwardly therefrom. Manipulation of the tail causes the neck member to be curled upwardly and rearwardly from its normal outwardly extended position whereby the head portion is retracted to the interior of the cup portion or slightly thereabove. The device is operable to engage ring-like game elements by inserting the hook-like tongue into an element and thereafter manipulating the tail to curl neck member rearwardly to deposit the element within the cup portion.

While obviously the device of the instant invention is suitable for use simply as an amusement toy or in various types of amusement games, it is particularly intended for use in one such game for repositioning game elements in the manner hereinabove described. In this connection, a plurality of ring-like elements are positioned in a centrally disposed open tray on a flat supporting surface. Game players situated around the tray then remove the elements from the tray using the dragon-like devices of the instant invention and reposition the elements in the respective cup portions of their devices. The players each have their own dragon-like devices and must leave the body portions of their devices flat on the supporting surface around the tray. By manipulating the dragon-like devices, the players move the neck members thereof into the tray to engage the game elements. Each player, however, is only permitted to have the neck member of his or her dragon-like device enter the tray through a particular preassigned peripheral area of the tray. After the game is started, the players are free to manipulate their game devices at will in competition for the game elements. When all of the elements have been removed from the tray, the game is concluded and the player with the greatest quantity of ring elements in his or her cup portion is deemed to be the game winner. In this way, the device of the instant invention functions in a novel and interesting manner while simulating a dragon-like figure in its movement.

Accordingly, it is an object of the instant invention to provide an amusement game device whereby game players may reposition ring-like game elements in a unique and amusing way while simultaneously playing a competitive game.

It is a further object of the instant invention to provide an amusement game device substantially in the configuration of a dragon which is operable with dragon-like movement to effect repositioning of ring-like game elements.

A still further object of the instant invention is to provide an amusement game device having an elongated flexible neck member which is remotely manipulated to effect upward and rearward curling thereof.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention:

FIG. 1 is a perspective view of the device of the instant invention as used for removing game rings from an open tray;

FIG. 2 is a perspective view of the device with the neck member thereof curled rearwardly to reposition a game ring in the cup portion of the device;

FIG. 3 is a bottom plan view of the device with the neck member thereof in its normal outwardly extended position;

FIG. 4 is a side sectional view taken along line 4—4 in FIG. 2; and

FIG. 5 is an enlarged sectional view taken along line 5—5 in FIG. 1.

DESCRIPTION OF THE INVENTION

Referring now to the drawing, the device of the instant invention is generally indicated at 10 in FIGS. 1 through 4. The device 10 is formed in the configuration of a dragon-like figure and generally comprises an open dish member 12, an elongated hollow flexible neck member 14 which normally extends outwardly from the dish member 12, a head portion 16 which includes an outwardly extending hook-like tongue 18, an elongated flexible strap 20 which extends longitudinally through the interior of the neck member 14 from the head portion 16 to the dish member 12, and a plunger assembly 22 which is connected to the strap 20. The plunger assembly 22 is operable to pull the strap 20 towards the dish member 12 whereby the neck member 14 is curled upwardly and rearwardly to retract the head portion 16 to the open interior of the dish member 12 or slightly thereabove.

The dish member 12 comprises a body portion 24 which is formed substantially in the configuration of a dragon-like body and an open circular cup portion 26 which is mounted within the body portion 24. As herein embodied, the dish member 12 is of unitary construction, being molded of a suitable rigid plastic material to provide an attractive and interesting hollow shell structure which includes feet 28 and scales 30 which simulate dragon features on the body portion 24. The body portion 24 provides a supporting base for the cup portion 26 whereby the dish member 12 is positionable on a supporting surface with the cup portion 26 in slightly upwardly spaced relation thereto to provide clearance beneath the cup portion 26 for the plunger assembly 22.

The neck member 14 which extends outwardly from the dish member 12 includes a plurality of hingedly interconnected neck segments 32 comprising, substantially rectangular bottom wall segments 34 and tunnel-like enclosure portions 36 which are defined by opposed upwardly tapered trapezoidal side walls 38 and top walls 40. As herein embodied, the neck member 14 is also of unitrary construction, being cast of a suitable semiflexible plastic material such as polyproylene. In this connection, the segments 34 are hingedly interconnected by flexible living hinge segments 42 of substantially reduced wall thickness having slots 44 therethrough to increase the flexibility thereof. In combination, the neck segments 32 and the hinge segments 42 define the hollow elongated flexible neck member 14. Upward flexibility of the neck member 14 is provided by the hinge segments 42 while clearance between the segments 32 for upward movement of the member 14 is provided by the upwardly tapered trapezoidal configurations of the neck segment side walls 38.

The head portion 16 functions mainly as a hook member extending from the outer end of the neck member 14 and therefore includes the hook-like tongue 18. As herein embodied, the head portion 16 is attractively formed in the configuration of a dragon head with eyes 46 and a snout 48 from which the tongue 18 extends. It is understood, however, that the tongue 18 may be alternatively formed as an integral extension of the strap 20, the important point being to provide an outwardly extending member at the outer extremity of the neck member 14 for securing game elements as will hereinafter be more fully brought out.

The strap 20 comprises an elongated flexible member 50 which is secured to the interior of the head portion 16 as at 51 and extends longitudinally through the hollow interior of neck member 14, a plurality of downwardly extending spacer tabs 52 which position the flexible member 50 in upwardly spaced relation to the bottom wall segments 34 and a terminal T bar end 54. As hereinbefore noted, the strap 20 extends through the entire neck member 14 and into the dish member 12.

The plunger assembly 22 which is operable to pull the strap 20 rearwardly within the dish member 12 is illustrated in FIGS. 3 and 4. As will be seen, the plunger assembly 22 comprises a guide 56 which is secured to the underside of the dish member 12 with tabs 58, and a plunger 60 which is slidably received in the guide 56. Included in the guide 56 are downwardly extending side walls 62 and a bottom wall 64 whereby the guide 56 defines an interior passage or channel 65 for the plunger 60. The plunger 60 comprises an arcuate slide 66 having transverse vertical interior partitions 68, an inner carriage 70 having a substantially vertical slot 72 in the inner end thereof and a handle member 74 which is generally in the configuration of a dragon tail. The strap 20 is secured to the plunger 60 with the T bar end 54 thereof in the slot 72.

As will be seen from the drawing, the device 10 is movable between the positions thereof illustrated in FIGS. 1 and 2 by manipulation of the plunger assembly 22. In this connection, movement of the handle 74 rearwardly away from the dish member 12 moves the plunger 60 in the guide 56 to pull the strap 20 rearwardly. As seen particularly from FIG. 4, movement of the strap 20 in this manner causes the neck member 14 to be curled upwardly and rearwardly to move the head portion 16 into or slightly above the cup portion 26 as illustrated in FIGS. 2 and 4. Movement of the handle 74 in a forward direction returns the neck member 14 to its outwardly extended position illustrated in FIGS. 1 and 3.

It is seen that the device 10 provides an interesting and unique amusement game device which is usable to effect repositioning of ring-like game elements. As will be seen from FIGS. 1 and 2, when the device 10 is used in combination with a tray 76 having one or more ring-like game elements 78 therein, the elements 78 are repositionable upon insertion of the hook-like tongue 18 therein. For convenience the ring-like elements 78 have cross bars 80 attached thereto to prevent them from laying flat in the tray 76 whereby the tongue 18 may be easily inserted therein. After one or more of the elements 78 have been secured on the tongue 18, the handle 74 is moved rearwardly away from the dish member 12 to curl the neck member 14 upwardly and rearwardly, whereby the elements 78 may be deposited in the cup portion 26. The use of the device 10 in this manner to secure the elements 78 in a competitive amusement game of the type hereinabove described provides an effective means for capturing the attention of game players in a new and unique way. The device 10 may be used by players of all ages to provide them with substantial amusement for extended periods of time and it therefore represents a significant advancement in the art of amusement game devices.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An amusement game device comprising:

a. a plurality of ring-like game elements having cross bars or the like thereon for preventing said game elements from lying flat on a support surface;

b. an open dish member positionable on said supporting surface;

c. an elongated flexible neck member attached to said dish member;

d. means for remotely manipulating said neck member to move it between a substantially straight outwardly extended position and an upwardly and rearwardly curled position wherein the terminal end of said neck member is above said open dish member; and e. hook means attached to the terminal end of said neck member receivable in said ring-like game elements for securing same therewith, by moving said dish member on said supporting surface and manipulating said neck member manipulating means, when said neck member is substantially in said outwardly extended position and said game elements are disposed adjacent the terminal end of said neck member, whereupon said hook means is operable for moving said game elements to said dish member by manipulating said neck member manipulating means to move said neck member to said upwardly and rearwardly curled position.

2. In the device of claim 1, said means for remotely manipulating said neck member comprising:

(a) an elongated flexible strap which is attached to said device adjacent the outer end of said neck member and extends longitudinally through said neck member; and (b) plunger means attached to the inner end of said strap and to said dish member and manipulatable from the opposite side of said dish member from said neck member to pull said strap toward said dish member.

3. In the device of claim 2, said dish member comprising:

a. a body portion positionable on a supporting surface; and b. an open cup portion mounted in said body portion.

4. In the device of claim 3, said dish member further characterized in that when said body portion is positioned on a supporting surface, the bottom of said cup portion is spaced upwardly from said surface, said plunger means extending beneath said cup portion.

5. The device of claim 4, further characterized as a dragon-like figure, said body portion comprising the body and legs of said figure, said neck member comprising the neck of said dragon figure, said hook means comprising the head and extended tongue of said figure and said plunger means including a handle portion which defines a tail of said figure.

6. In the device of claim 1, said neck member comprising a plurality of substantially flat rectangular bottom wall segments; means connecting said segments in a hingeable manner in end to end relation to define an elongated upwardly bendable bottom wall of connected wall segments; means extending upwardly from the side edges of said wall segments to define individual longitudinal tunnel-like enclosures thereabove, which in combination with their respective bottom wall segments define a plurality of hollow neck member segments which comprise said hollow neck member, the ends of said enclosure means being upwardly and inwardly tapered to provide upwardly increasing clearance therebetween to permit upward bendability of said neck member, said means for remotely manipulating said neck member comprising an elongated flexible strap which is attached to said device adjacent the outer end of said neck member and extends longitudinally through said neck member; and means for manipulating the inner end of said strap to pull said strap toward said dish member and thereby curl said neck member upwardly and rearwardly to move said hook means toward said dish member, said strap being normally spaced slightly upwardly from said bottom wall segments.

7. In the device of claim 6 said upwardly bendable bottom wall being of unitary construction molded of a semiflexible plastic material, said means for hingeably connecting said segments comprising transverse living hinge segments of reduced wall thickness in said bottom wall.

* * * * *